US009341194B2

(12) United States Patent
Lockyer

(10) Patent No.: US 9,341,194 B2
(45) Date of Patent: May 17, 2016

(54) GAS TURBINE ENGINE COMPRESSOR WITH A BIASED INNER RING

(71) Applicant: Solar Turbines Incorporated, San Diego, CA (US)

(72) Inventor: John Frederick Lockyer, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 841 days.

(21) Appl. No.: 13/666,758

(22) Filed: Nov. 1, 2012

(65) Prior Publication Data

US 2014/0119895 A1 May 1, 2014

(51) Int. Cl.

*F04D 29/56* (2006.01)
*F01D 17/16* (2006.01)
*F01D 11/00* (2006.01)

(52) U.S. Cl.

CPC ..... *F04D 29/563* (2013.01); *F01D 17/162* (2013.01); *F01D 11/001* (2013.01); *F05D 2300/501* (2013.01)

(58) Field of Classification Search

CPC ..... F04D 29/563; F04D 29/66; F04D 29/668; F01D 5/10; F01D 5/16; F01D 5/26; F01D 25/04; F01D 25/06; F01D 25/164; F01D 17/162; F01D 17/167

USPC ..... 415/148, 208.1, 151, 159, 160; 29/889.22

See application file for complete search history.

(56) References Cited

U.S. PATENT DOCUMENTS 2,671,634 A * 3/1954 Morley ..... A01N 25/08 415/149.4
2,778,564 A * 1/1957 Halford ..... F01D 17/162 138/46
3,542,484 A * 11/1970 Mason ..... F01D 17/162 415/147
3,720,217 A * 3/1973 Matthews ..... F02C 9/20 137/805
5,083,900 A 1/1992 Carletti et al.
6,767,183 B2 7/2004 Schilling et al.
7,445,427 B2 * 11/2008 Gutknecht ..... F01D 17/162 415/160
8,038,387 B2 * 10/2011 Houradou ..... F01D 17/162 384/215
2005/0276686 A1 12/2005 Bruce
2008/0031730 A1 2/2008 Houradou et al.
2013/0216359 A1 8/2013 Brandenburg et al.
2013/0259658 A1 * 10/2013 Dube ..... F01D 5/10 415/148

FOREIGN PATENT DOCUMENTS

GB 2445863 A 7/2008

* cited by examiner

*Primary Examiner* — Richard Edgar
*Assistant Examiner* — Brian O Peters
(74) *Attorney, Agent, or Firm* — Procopio, Cory, Hargreaves & Savitch LLP

(57) ABSTRACT

An inner bushing assembly (280) to provide a biasing force between a guide vane (260) and an inner ring half (261) of a gas turbine engine compressor (200) is disclosed. The inner bushing assembly (280) includes a first bushing (281), a second bushing (282), and a biasing element (283). The first bushing (281) is configured to be installed about an inner vane shaft (267) of the guide vane (260) adjacent to an airfoil (265) of the guide vane (260). The second bushing (282) is configured to be installed about the inner vane shaft (267) distal to the airfoil (265). The biasing element (283) is configured to be installed about the inner vane shaft (267) between the first bushing (281) and the second bushing (282).

20 Claims, 4 Drawing Sheets

GAS TURBINE ENGINE COMPRESSOR WITH A BIASED INNER RING

TECHNICAL FIELD

The present disclosure generally pertains to gas turbine engines, and is more particularly directed toward a compressor with a biased inner ring of a gas turbine engine.

BACKGROUND

Gas turbine engines include compressor, combustor, and turbine sections. The compressor may be built up in three assemblies: the compressor rotor assembly and two compressor stator assemblies. The compressor rotor assembly may be built up and balanced. The two compressor stator assemblies may be bolted together over the compressor rotor assembly. Portions of the assembly of the two compressor stator assemblies over the compressor rotor assembly may be blind.

U.S. patent application pub. No. 2008/0031730 to E. Houradou discloses a bearing for a turbomachine variable pitch stator vane pivot mounted in a bore of the turbomachine casing, and which comprises an inner busing secured to said pivot and an outer bushing secured to said bore, an elastomeric material being inserted between the inner bushing and the outer bushing to allow the vane to pivot about its axis and absorb at least some of the flexing of the pivot at right angles to the axis. The design makes it possible to reduce bearing bushing wear.

The present disclosure is directed toward overcoming one or more of the problems discovered by the inventors.

SUMMARY OF THE DISCLOSURE

An inner bushing assembly to a biasing force between a guide vane and an inner ring half of a gas turbine engine compressor is disclosed. The inner bushing assembly includes a first bushing, a second bushing, and a biasing element. The first bushing is configured to be installed about an inner vane shaft of the guide vane adjacent to an airfoil of the guide vane. The second bushing is configured to be installed about the inner vane shaft distal to the airfoil. The biasing element is configured to be installed about the inner vane shaft between the first bushing and the second bushing.

DETAILED DESCRIPTION

The systems disclosed herein include a gas turbine engine compressor with a compressor stator assembly. In embodiments, the gas turbine engine compressor stator assembly includes two compressor stator assembly halves. Each compressor stator assembly half includes variable guide vanes, inner bushing assemblies, and an inner ring. Each inner bushing assembly includes a biasing element. Each inner bushing assembly may react against a variable guide vane and the inner ring to center and clamp the two halves of the inner ring together. Centering and clamping the inner ring may increase the efficiency of the gas turbine engine and may reduce wear on the inner ring.

Figure 1:
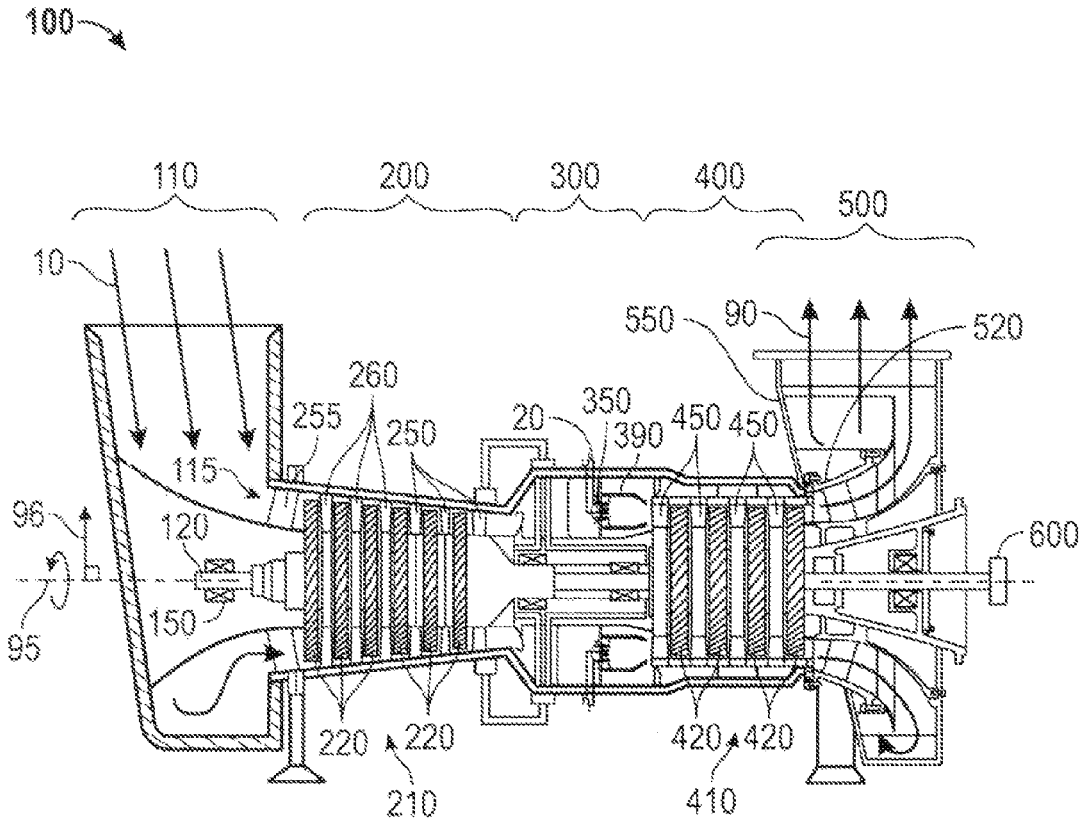
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a shaft 120, a gas producer or "compressor" 200, a combustor 300, a turbine 400, an exhaust 500, and a power output coupling 600. The gas turbine engine 100 may have a single shaft or a dual shaft configuration.

The compressor 200 includes a compressor rotor assembly 210 and two compressor stator assembly halves 251. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor disk 221 (shown in FIG. 2) that is circumferentially populated with compressor rotor blades 230 (shown in FIG. 2).

Each compressor stator assembly half 251 includes compressor stationary vanes ("stators") 250, half of compressor case 205, and inlet guide vanes 255. Each compressor stator assembly half 251 can include multiple sets of stators 250. Each set may include half of the stators 250 of a compressor stage. Compressor stator assembly halves 251 are coupled together at compressor case 205 around compressor rotor assembly 210. Compressor case 205 may include compressor case split lines 206 (shown in FIG. 3). Stators 250 axially follow each of the compressor disk assemblies 220. Each compressor disk assembly 220 paired with the adjacent stators 250 that follows the compressor disk assembly 220 is considered a compressor stage. Compressor 200 includes multiple compressor stages. Stators 250 may be variable guide vanes 260. Inlet guide vases 255 may also be variable guide vanes 260.

The combustor 300 includes one or more injectors 350 and includes one or more combustion chambers 390.

The turbine 400 includes a turbine rotor assembly 410 and turbine nozzles 450. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades. Turbine nozzles 450 axially precede each of the turbine disk assemblies 420. Each turbine disk assembly 420 paired with the adjacent turbine nozzles 450 that precede the turbine disk assembly 420 is considered a turbine stage. Turbine 400 includes multiple turbine stages.

The exhaust 500 includes an exhaust diffuser 520 and an exhaust collector 550.

Figure 2:
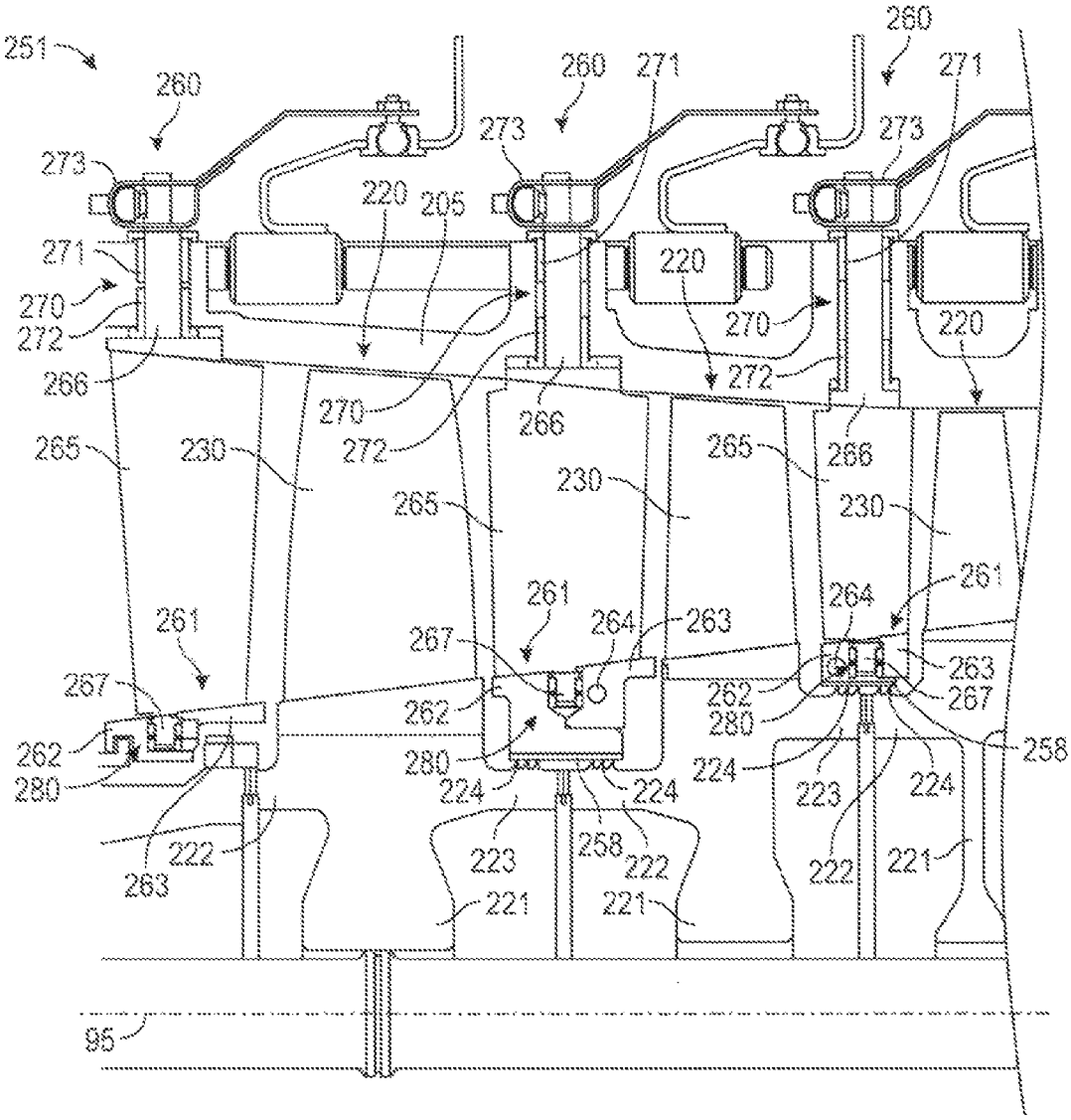
FIG. 2 is a cross-sectional view of a portion of the gas turbine engine compressor of FIG. 1.

FIG. 2 is a cross-sectional view of a portion of the compressor 200 of FIG. 1. In the embodiment shown, each of the three stator sections includes variable guide vanes 260. In another embodiment the first four stages include variable guide vanes 260. However, any number of compressor stages may include variable guide vanes 260.

Figure 3:
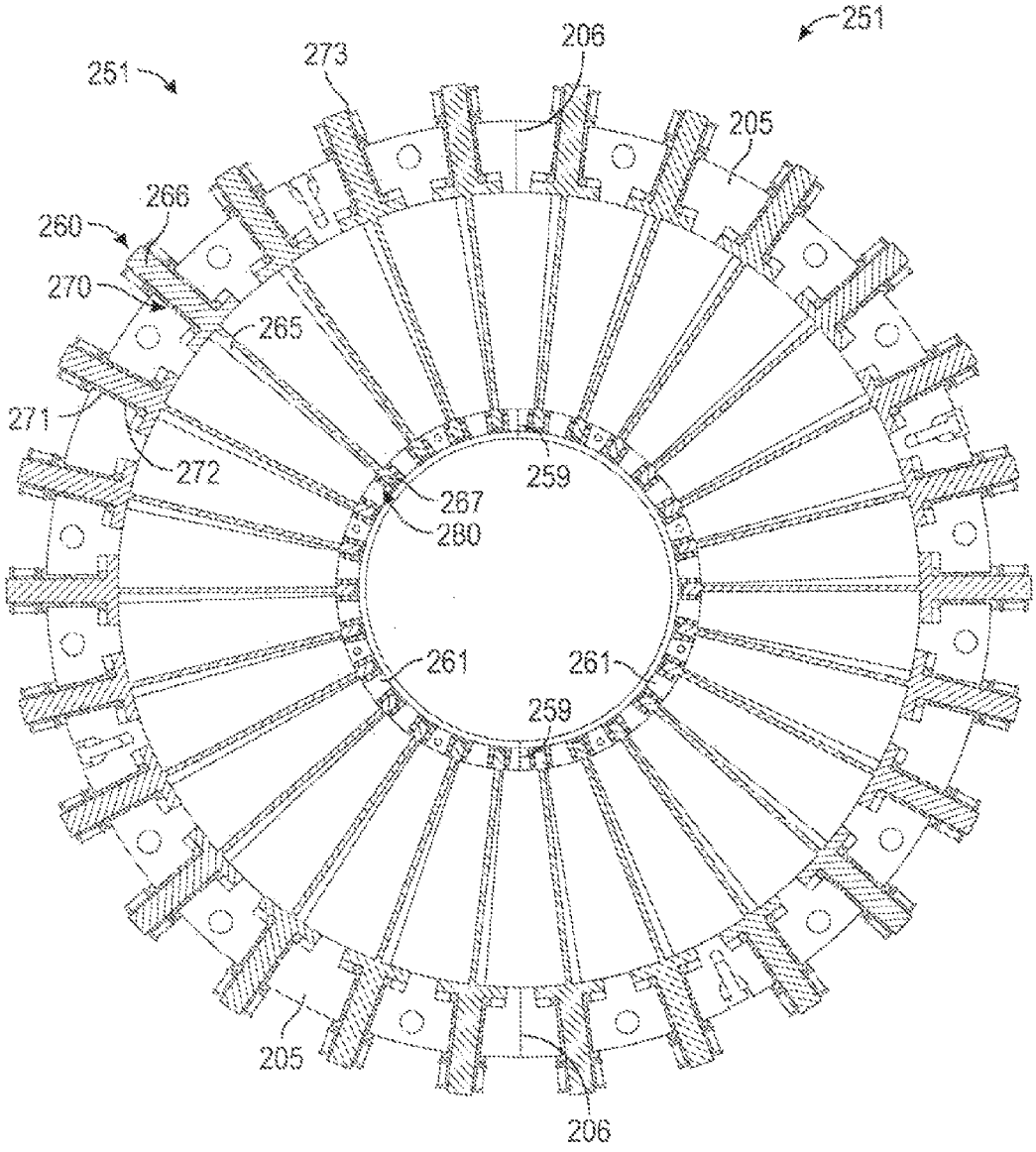
FIG. 3 is an axial crass-section of two compressor suitor assemblies of the compressor of FIG. 2.

FIG. 3 is an axial cross-section of two compressor stator assembly halves 251 of FIG. 2 shown assembled in isolation from other compressor 200 assemblies. Referring to FIGS. 2 and 3, each compressor stator assembly half 251 may include one or more inner ring halves 261, one or more sets of variable guide vanes 260, outer bushings 270, inner bushing assemblies 280, and curved springs 273. Each inner ring half 261 is located radially inward from compressor case 205. The inner ring split lines 259 between assembled inner ring halves 261 may be at 12:00 o'clock and 6:00 o'clock. Inner ring split lines 259 circumferentially align with compressor case split lines 206. As illustrated in FIG. 2, each inner ring half 261 includes a forward ring 262 and an aft ring 263. In the embodiment shown in FIG. 2, the compressor stator assembly half 251 includes three sets of variable guide vanes 260 and three inner ring halves 261. Each inner ring half 261 is paired with one set of variable guide vanes 260.

Referring to FIG. 2, each inner ring half 261 may include dowels 264. Dowels 264 may be located on the end surfaces of each inner ring half 261. Each dowel may be located on the forward ring 262 or the aft ring 263. Each dowel 264 may be a dowel pin or a dowel hole. The dowel pin being a cylindrical pin extending out from an end surface of an inner ring half 261 and the dowel hole being a cylindrical blind hole extending into an inner ring half 261 from an end surface of the inner ring half 261.

Referring again to FIGS. 2 and 3, each variable guide vane 260 may include an airfoil 265, an outer vane shaft 266, and an inner vane shaft 267. Each airfoil 265 may extend between compressor case 205 and an inner ring half 261. Outer vane shaft 266 may extend radially outward from airfoil 265 through compressor case 205. Inner vane shaft 267 may extend radially inward from airfoil 265 into an inner ring half 261. Inner vane shaft 267 may not extend through the inner ring half 261.

Figure 4:
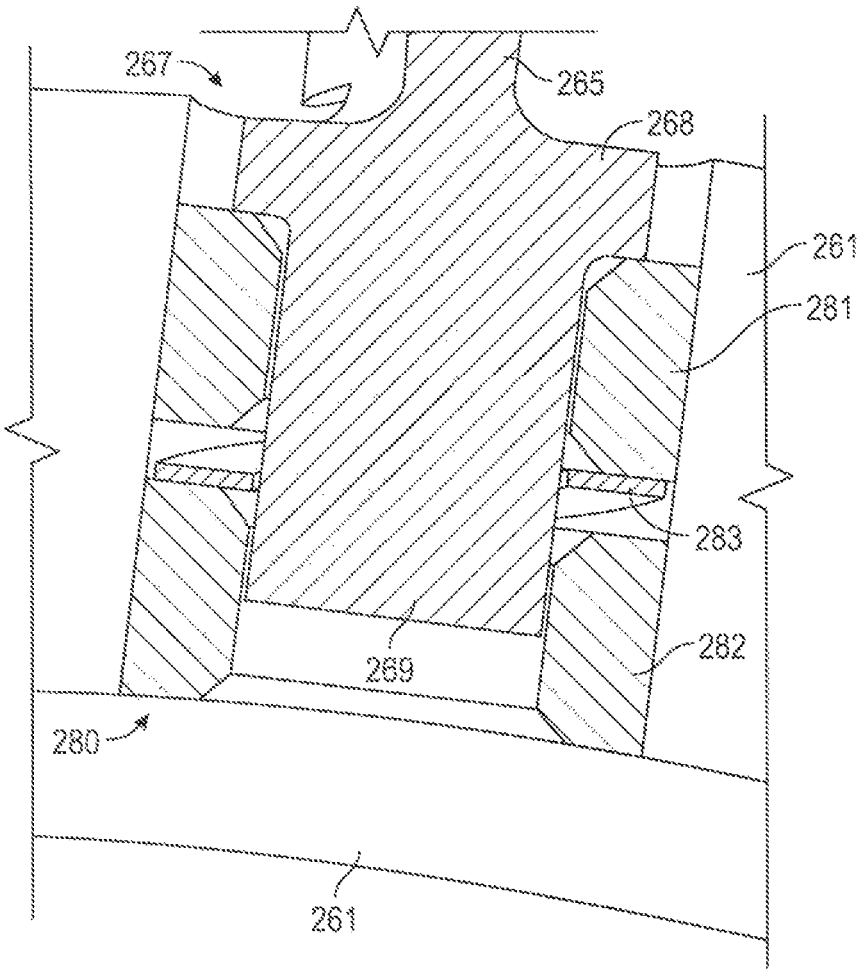
FIG. 4 is cross-sectional view of an inner bushing assembly of FIG. 3.

FIG. 4 is a cross-sectional view of one embodiment of the inner bushing assembly 280 of FIG. 3. Each inner vane shaft 267 has a T-shaped cross-section and includes a collar portion 268 adjacent the air foil 265 and a shaft portion 269 extending from the collar portion 268 away from the airfoil 265.

Inner bushing assembly 280 may be located about shaft portion 269 radially between collar portion 268 and an inner ring half 261. Collar portion 268 and the inner ring half 261 may trap inner bushing assembly 280 in place. The inner hushing assembly 280 can be a split bushing and includes a first bushing 281, a second hushing 282, and a biasing element 283. The biasing element 283 provides force in the radial direction. First bushing 281 is located adjacent to collar portion 268. Second bushing 282 is located proximal to first bushing 281, distal to collar portion 268. First bushing 281 and second bushing 282 may be manufactured from thermoplastics such as Imilon 514. First bushing 281 and second bushing 282 may each have a cylindrical shape configured with a bore and sized to receive shaft portion 269. The top and bottom edges of first bushing 281 and second bushing 282 that are adjacent to the bore may be chamfered.

Biasing element 283 is located between first bushing 281 and second bushing 282. Alternatively, a single bushing may be used with an adjacent biasing element. The adjacent biasing element may be located radially inward or radially outward from the single bushing to provide a force in the radial direction. In the embodiment shown in FIG. 4, biasing element 283 is a spring washer, such as a wave waster or a curved spring washer. In one embodiment, the wave washer has three convolutions.

Referring to FIGS. 2 and 3, outer bushing 270 may be located about outer vane shaft 266 and radially within compressor case 205. Outer bushing 270 may also be a split bushing including a third bushing 271 and a fourth bushing 272. Fourth bushing 272 may be proximal to airfoil 265. Third bushing 271 may be proximal to fourth bushing 272, distal to airfoil 265. Third bushing 271 and fourth bushing 272 may have a radial clearance there between.

As illustrated in FIGS. 2 and 3, outer vane shaft 266 may extend from airfoil 265 beyond outer bushing 270 and compressor case 205. Curved spring 273 may be attached to outer vane shaft 266 adjacent to compressor case 205 at the end of outer vane shaft 266 distal to airfoil 265.

Referring now to FIG. 2, each compressor disk 221 is coupled to shaft 120 and may include a forward wing 222, an aft wing 223, and labyrinth teeth 224. Forward wing 222 may extend axially forward and aft wing 223 may extend axially aft. The forward wing 222 of a compressor disk 221 may contact the aft wing 223 of an adjacent compressor disk 221 radially inward of inner ring halves 261. Labyrinth teeth 224 may extend radially outward from forward wing 222 and aft wing 223 towards inner ring halves 261. Each inner ring half 261 may include labyrinth running surface 258 adjacent labyrinth teeth 224.

As previously mentioned, each compressor disk 221 may be circumferentially populated with compressor rotor blades 230. Compressor rotor blades 230 extend radially outward from compressor disk 221. A portion of compressor case 205 may shroud compressor rotor blades 230 proximal the tips of the compressor rotor blades 230.

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T alloys, and CMSX single crystal alloys.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction, going from the inlet 110 towards the exhaust 500). Likewise, each turbine disk assembly 420 may be associated with a numbered stage.

Once compressed air 10 leaves the compressor 200, it enters the combustor 300, where it is diffused and fuel 20 is added. Air 10 and fuel 20 are injected into the combustion chamber 390 via injector 350 and ignited. After the combustion reaction, energy is then extracted from the combusted fuel/air mixture via the turbine 400 by each stage of the series of turbine disk assemblies 420. Exhaust gas 90 may then, be diffused in exhaust diffuser 520 and collected, redirected, and exit the system via an exhaust collector 550. Exhaust gas 90 may also be further processed (e.g., to reduce harmful emissions, and/or to recover heat from the exhaust gas 90).

During assembly of the compressor 200, the compressor rotor assembly 210 may be coupled to shaft 120. Each compressor stator assembly half 251 is assembled working outside in, from half of the compressor case 205 to inner ring half 261. Outer bushings 270, airfoils 265, and curved springs 273 may be coupled to half of compressor case 205. After inner bushing assemblies 280 are assembled onto inner vane shafts 267, a forward, ring 262 and an aft ring 263 are coupled to airfoils 265 about inner vane shafts 267 and inner bushing assemblies 280.

The two compressor stator assembly halves 251 may be placed around compressor rotor assembly 210 and shaft 120. The compressor case 205 is then coupled together at compressor case split lines 206. In one embodiment, bolts are used to couple the compressor case 205. The assembly of the inner ring halves 261 of the two compressor stator assembly halves 251 may be a blind assembly. During assembly of the two compressor stator assembly halves 251 around compressor rotor assembly 210 the inner ring halves 261 of each compressor stator assembly half 251 may not be visible. Dowels 264 located on the end surfaces of each inner ring half 261 may guide the inner ring halves 261 together as the two compressor stator assemblies are joined together. Dowel pins of one inner ring half 261 may insert into dowel holes of the other inner ring half 261.

Referring to FIG. 3, the inner ring halves 261 may not be clamped or bolted together due to the blind assembly. The inner ring halves 261 may separate, which may decrease efficiency due to air to leak through the inner ring split lines 259. The separation may also increase due clearance between the inner ring halves 261 and the labyrinth teeth 224, which may decrease efficiency due to air leak through the labyrinth seal. Inner ring halves 261 may shift positions causing rubs during break-in or operation of the gas turbine engine 100.

Inconsistencies in the position of inner ring halves 261 relative to labyrinth teeth 224 may cause lockup issues during testing and engine break-in which may cause test delays and possible engine down time for gas turbine engine operators. Lockup may occur during a hot engine restart due to rotor bow and misalignment of engine components such as inner ring halves 261. Contact between inner ring halves 261 and labyrinth teeth 224 may also result in scoring or gouging of inner ring halves 261, which may reduce the operating life of the inner ring halves 261.

Excess clearances due to the movement of inner ring halves 261 may cause variable guide vanes 260 to flutter. Fluttering of the variable guide vanes 260 may reduce the operating life of variable guide vanes 260 due to high cycle fatigue. Fluttering variable guide vanes may cause an unsteady flow across multiple stages of the compressor and may cause compressor rotor blades 230 to flutter. Fluttering of the compressor rotor blades 230 may reduce die operating life of compressor rotor blades 230 due to high cycle fatigue.

Referring now to FIG. 4, providing biasing element 283 can center each inner ring half 261 within compressor 200 and can clamp inner ring halves 261 together. Each inner bushing assembly 280 may react against a variable guide vane 260 and inner ring half 261 to center inner ring halves 261 and clamp inner ring halves 261 together. In the embodiment shown in FIG. 4, each inner bushing assembly 280 may react against a collar portion 268, which may provide a radial force to each inner ring half 261, clamping inner ring halves 261 together.

The centering and clamping of inner ring halves 261 may prevent or reduce misalignment with labyrinth teeth 224, which may prevent or reduce rubbing, scoring, and gouging. Preventing or reducing misalignment of inner ring halves 261 may also reduce or prevent air from leaking back through die labyrinth seal, which may increase efficiency. The centering and clamping of inner ring halves 261 may also prevent lockup of gas turbine engine 100.

Eliminating or reducing excess clearance by preventing or reducing misalignment of inner ring halves 261 may eliminate or reduce the flutter of variable guide vanes 260 and compressor rotor blades 230, which may increase the operating life of the variable guide vanes 260 and the compressor rotor blades 230.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes particular Compressor stator assembly halves and associated processes, it will be appreciated that other compressor stator assembly halves and processes in accordance with this disclosure can be implemented in various other compressor stages, configurations, and types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. An inner bushing assembly to provide a biasing force between a guide vane and an inner ring half of a gas turbine engine compressor, the inner bushing assembly comprising:

a first bushing configured to be installed about an inner vane shaft of the guide vane adjacent to an airfoil of the guide vane;

a second bushing configured to be installed about the inner vane shaft distal to the airfoil; and a biasing element configured to be installed about the inner vane shaft between the first bushing and the second bushing, the biasing element configured to separate the first bushing and the second bushing.

2. The inner bushing assembly of claim 1, wherein the biasing element comprises a spring washer.

3. The inner bushing assembly of claim 2, wherein the spring washer comprises a wave washer.

4. The inner bushing assembly of claim 3, wherein the wave washer includes three convolutions.

5. The inner bushing assembly of claim 1, wherein the first bushing comprises a thermoplastic and the second bushing comprises a thermoplastic.

6. A compressor stator assembly half for a gas turbine engine compressor, comprising:

a plurality of variable guide vanes, each variable guide vane having an airfoil, and an inner vane shaft extending from the airfoil, the inner vane shaft including a collar portion, and a shaft portion;

a plurality of inner bushing assemblies, each inner bushing assembly having a first bushing located about the shaft portion and adjacent the collar portion of one of the plurality of variable guide vanes, a second bushing located about the shaft portion and distal to the collar portion of one of the plurality of variable guide vanes, and a biasing element located about the shaft portion of one of the plurality of variable guide vanes and between the first bushing and the second bushing, the biasing element configured to separate the first bushing and the second bushing; and an inner ring half coupled to the plurality of variable guide vanes.

7. The compressor stator assembly half of claim 6, further comprising:

a half of a compressor case;

each variable guide vane further having an outer vane shaft extending from the airfoil distal to the inner vane shaft extending through the compressor case;

a plurality of outer bushings, each outer bushing is located within the half of the compressor case and about the outer vane shaft of one of the plurality of variable guide vanes; and a plurality of curved springs located adjacent to the compressor case attached to an end of the outer vane shaft distal the airfoil of one of the plurality of variable guide vanes.

8. The compressor stator assembly half of claim 7, further comprising a plurality of inlet guide vanes, wherein each inlet guide vane is a variable guide vane.

9. The compressor stator assembly half of claim 6, wherein the inner ring half includes a forward ring and an aft ring.

10. The compressor stator assembly half of claim 6, wherein the biasing element comprises a spring washer.

11. The compressor stator assembly half of claim 10, wherein the spring washer comprises a wave washer.

12. The compressor stator assembly half of claim 11, wherein the wave washer includes three convolutions.

13. The compressor stator assembly half of claim 6, wherein the first bushing comprises a thermoplastic and the second bushing comprises a thermoplastic.

14. A gas turbine engine including two compressor stator assembly halves of claim 6, wherein the compressor stator assembly halves are coupled together about a compressor rotor assembly.

15. A compressor stator assembly half for a gas turbine engine compressor, comprising:

a plurality of variable guide vanes, each variable guide vane having an airfoil, and an inner vane shaft extending from the airfoil, the inner vane shaft including a shaft portion, and a collar portion adjacent to the airfoil;

an inner ring half coupled to the plurality of variable guide vanes about each inner vane shaft; and a plurality of inner bushing assemblies, each inner bushing assembly having a first bushing located about the shaft portion and adjacent the collar portion of one of the plurality of variable guide vanes, a second bushing located about the shaft portion and distal to the collar portion of one of the plurality of variable guide vanes, and a biasing element located about the shaft portion of one of the plurality of variable guide vanes and between the first bushing and the second bushing, the biasing element configured to separate the first bushing and the second bushing, wherein the biasing element provides a radial force to the inner ring half.

16. The compressor stator assembly half of claim 15, further comprising:

a half of a compressor case;

each variable guide vane further having an outer vane shaft extending from the airfoil distal to the inner vane shaft extending through the compressor case;

a plurality of outer bushings, each outer bushing is located within the half of the compressor case and about the outer vane shaft of one of the plurality of variable guide vanes; and a plurality of curved springs located adjacent to the compressor case attached to an end of the outer vane shaft distal the airfoil of one of the plurality of variable guide vanes.

17. The compressor stator assembly half of claim 15, wherein the biasing element comprises a spring washer.

18. The compressor stator assembly half of claim 15, wherein the spring washer comprises a wave washer.

19. The compressor stator assembly half of claim 15, wherein each inner bushing assembly is installed onto the shaft portion of one of the inner vane shafts between the collar portion and the inner ring half.

20. A gas turbine engine including two compressor stator assembly halves of claim 15, wherein the compressor stator assembly halves are coupled together about a compressor rotor assembly.

* * * * *